US005482275A

United States Patent [19]

Grinoch et al.

[11] Patent Number: 5,482,275

[45] Date of Patent: Jan. 9, 1996

[54] DEVICE AND METHOD FOR SILENT BRIDGE BIDDING

[76] Inventors: Abraham Grinoch, 27 Knollwood Rd., Morristown, N.J. 07960; Ethel Sheifer, 4301 N. Ocean Blvd., Boca Raton, Fla. 33431

[21] Appl. No.: 342,099

[22] Filed: Nov. 18, 1994

[51] Int. Cl.[6] ..... A63F 1/06

[52] U.S. Cl. ..... 273/142 HA; 273/148 R

[58] Field of Search ..... 273/142 HA, 142 H, 273/142 R, 148 R

[56] References Cited

U.S. PATENT DOCUMENTS

| | | | |
|---|---|---|---|
| 1,253,479 | 1/1918 | Ellithorpe | 273/148 R |
| 1,789,890 | 1/1931 | Agrell | 273/148 R |
| 1,932,442 | 10/1933 | Boore | 273/148 R |
| 2,007,055 | 8/1932 | Knust | 434/129 |
| 2,048,954 | 6/1932 | Shokler | 434/129 |
| 2,131,132 | 9/1938 | Alderman | 273/148 R |
| 4,074,442 | 2/1978 | Landry | 273/148 R |

FOREIGN PATENT DOCUMENTS

| | | | |
|---|---|---|---|
| 310167 | 4/1929 | United Kingdom | 273/148 R |

*Primary Examiner*—Benjamin H. Layno
*Attorney, Agent, or Firm*—William C. Long

[57] ABSTRACT

A device for non-verbal contract bridge bidding consisting of a base with two rotatable members mounted thereon, the base having four groups each having the same notations identifying the card suits, no trump, pass double and redouble spaced 90 degrees from each adjacent group, the first lower member having four open slots located 90 degrees apart adapted to expose one notation on the base, the lower member having four groups each having the same notations 1, 2, 3, 4, 5, 6 and 7 spaced 90 degrees apart, the second upper member having four open slots located 90 degrees apart sized to identically expose one notation on the first disk.

3 Claims, 6 Drawing Sheets

DEVICE AND METHOD FOR SILENT BRIDGE BIDDING

BACKGROUND OF THE INVENTION

1. Field of the Invention

The present invention relates to a device and method for standard and contract bridge bidding and especially to a device and method for non-verbal or silent bidding during a bridge game.

2. Description of the Prior Art

The game of bridge enjoys enormous popularity among players of all ages and abilities. Bridge is useful as a social activity as well as an intensely competitive activity as is the case in tournament or duplicate bridge.

Bridge bidding is, of course, a critical feature of any bridge game. In many situations, a real need exists for non-verbal bridge bidding. In duplicate or tournament bridge play, for example, non-verbal bidding is useful in reducing signalling or the transmission of information by words or by voice inflection.

Of special interest is the case where hearing or voice impaired individuals seek to compete with players who do not have such impairments. Obviously it would be advantageous to have means for silent bidding whereby all four players receive the same bidding information at the same time in a non-verbal way.

Methods have been proposed for non-verbal bridge bidding: see, for example, U.S. Pat. No. 3,420,526 to L. S. Berger which illustrates an electrically activated system with individual consoles for each player and the appropriate electrical circuitry for non-verbal bridge bidding.

See also U.S. Pat. No. 4,030,764 to A. V. Mattos which also describes an electrically operated system but with a plurality of indicia on a single console.

U.S. Pat. No. 3,784,719 to J. A. Mentzer provides a bridge bidding indicator with magnetic instruction cards for use by the beginner at bridge.

U.S. Pat. No. 2,007,055 provides a device for displaying card hands involving a rotatable member located below the card table in conjunction with a slotted display table, the device being useful for teaching card playing.

U.S. Pat. No. 2,048,954 provides a device for instruction in the correct play of card games such as contract bridge involving rotatable disks containing various indicia such as cards dealt, bids to be made, and the like.

In spite of the efforts of prior workers a need exists for a simple but effective method and device for non-verbal bidding during standard and contract bridge play, whether it be social or competitive play. The present invention is believed to provide such a device and method.

BRIEF DESCRIPTION OF THE INVENTION

In accordance with the present invention there is provided a non-verbal standard and contract bridge bidding device comprised of a base member marked in a circular mode with four identical groups of bridge bidding information comprised of each of the four suits, no trump (NT), pass (P), double (DBL) and redouble (RDBL). Each item of information is spaced 90 degrees from the same item of information in the group to either side of it. A first, lower rotatable member is provided with four slots spaced 90 degrees apart, the slots sized to correspond to the area on the base upon which a single item of information may be exposed. The lower rotatable member is sized to cover the information on the base except that which is identically shown through the open area of each of the four slots. The lower rotatable disk is also marked in a circular mode with four identical groups of bridge bidding information comprised of the numbers 1, 2, 3, 4, 5, 6, 7. An upper rotatable member is provided which also has four slots spaced 90 degrees apart, the slots sized to correspond to the area on the lower rotatable member upon which single items of information may be exposed. The upper rotatable member is sized to cover the information on the lower rotatable member except that which is identically shown through the open area of the four slots. The upper and lower members are concentrically mounted on and allow rotation compared to the base such that the slots and the information to be exposed correspond.

In one embodiment as will be described hereinafter, the base member is flat and the lower and upper rotatable members are circular disks. In another embodiment, the base is a truncated cone and the lower and upper rotatable members are also truncated cones adapted to stack on and rotate about the base.

In operation, a bidder rotates the lower member until the notation on the base of a particular suit, NT, P, DBL or RDBL is revealed identically to all four players through each of the four slots in the lower member. If P, DBL or RDBL has not been selected, the bidder then rotates the upper member until the desired number is identically revealed to all four players through each of the four slots on the upper member. The bidding then passes to the next bidder where the procedure is repeated and this continues until the final contract is ascertained.

DETAILED DESCRIPTION

The device of the invention can be constructed from any conveniently available material including paper, cardboard, plastic, metal, wood and the like as well as combinations of these materials. For example, it may be convenient to provide a base made of a heavier material such as wood or metal and rotatable members of lighter material such as plastic, cardboard or paper.

The device is sized to be conveniently placed near the center of a bridge table and observed by all four players during use.

Figure 1:
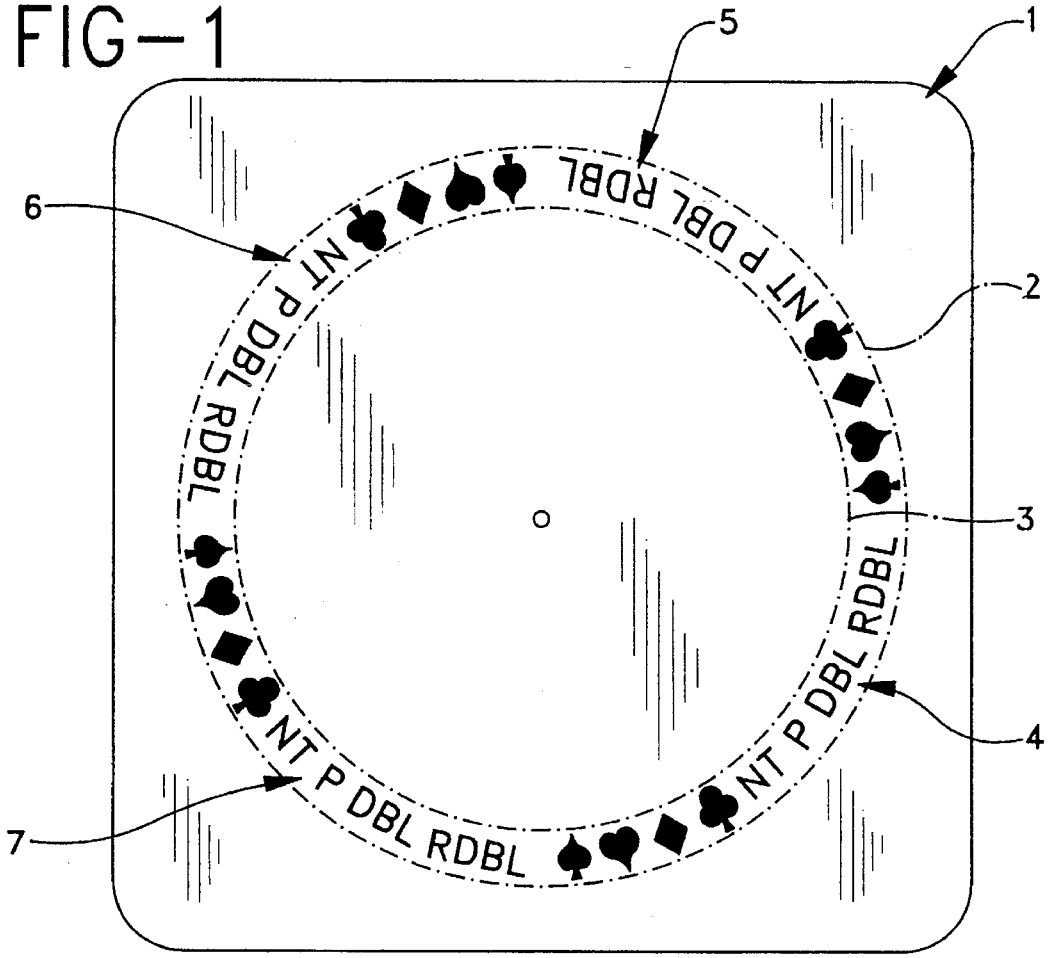
FIG. 1 is a plan view of the base member of one embodiment of the device of the invention.

Referring to FIG. 1, base 1 is a flat member which can be any convenient shape but is preferably a square or a circle. As depicted, provided on base 1 between concentric circles 2 and 3 are four identical groups or clusters 4, 5, 6 and 7 containing the bidding notations spade, heart, diamond, club, NT (no trump), P (pass), DBL (double) and RDBL (redouble). Concentric circles need not be drawn or painted on base 1. Equivalent notations can be provided; for example, the suits may be indicated by the appropriate symbol, by abbreviation, or by complete spelling. Note also that the notations can be in Braille or in raised print or design to permit use by the visually impaired. It is essential that each of the different notations be spaced 90 degrees from the corresponding notation on either side; at least the same corresponding notations should occupy the same area on base 1 although preferably all notations occupy about the same area for convenient viewing.

For ease of alignment each notation can be separated by lines from those adjacent it although this is not essential.

Figure 2:
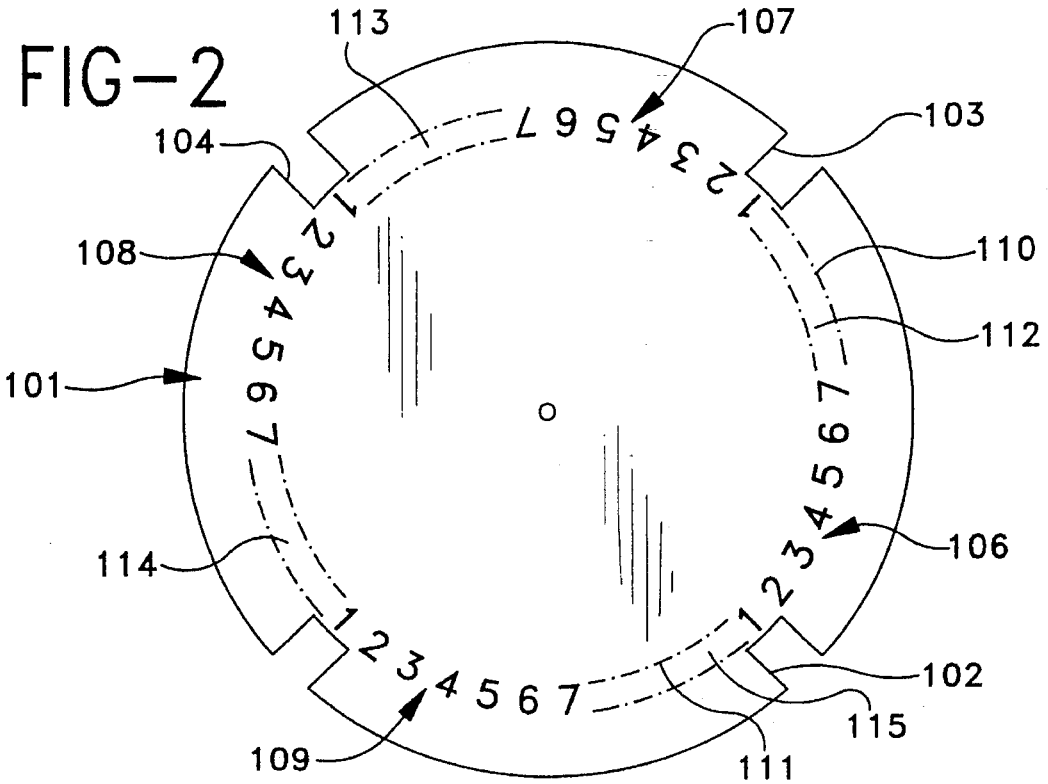
FIG. 2 is a plan view of the lower rotatable disk of one embodiment of the device of the invention.

FIG. 2 illustrates the lower rotatable disk 101 which is adapted to be mounted on base 1 at the center point of each. The diameter of disk 101 is preferably equal to or slightly larger than the diameter of circle 2 on base 1. Disk 101 has four open slots 102, 103, 104 and 105 which are spaced 90 degrees apart and which are sized to provide an open area which corresponds to the area of a single notation within the concentric circles 2 and 3 on base 1 such that disk 101 can be rotated and a single notation on base 1 will be revealed, the same notation being revealed through each of slots 102, 103, 104 and 105.

In addition to the slots, lower rotatable disk 101 has, as depicted, four identical groups or clusters 106, 107, 108 and 109 containing the bidding notations 1, 2, 3, 4, 5, 6 and 7. These notations are located between concentric circles 110 and 111, each particular notation being located 90 degrees from the same notations in the adjacent groups or clusters. Circles 110 and 111 need not appear on disk 101. At least the corresponding notations should occupy the same area although it is preferred for ease of viewing that all of the notations occupy about the same area. It is also preferred that blank areas 112, 113, 114 and 115 be provided for use when the notations P, DBL or RDBL are in view on base 1 since no numbers are necessary with these bids.

Figure 3:
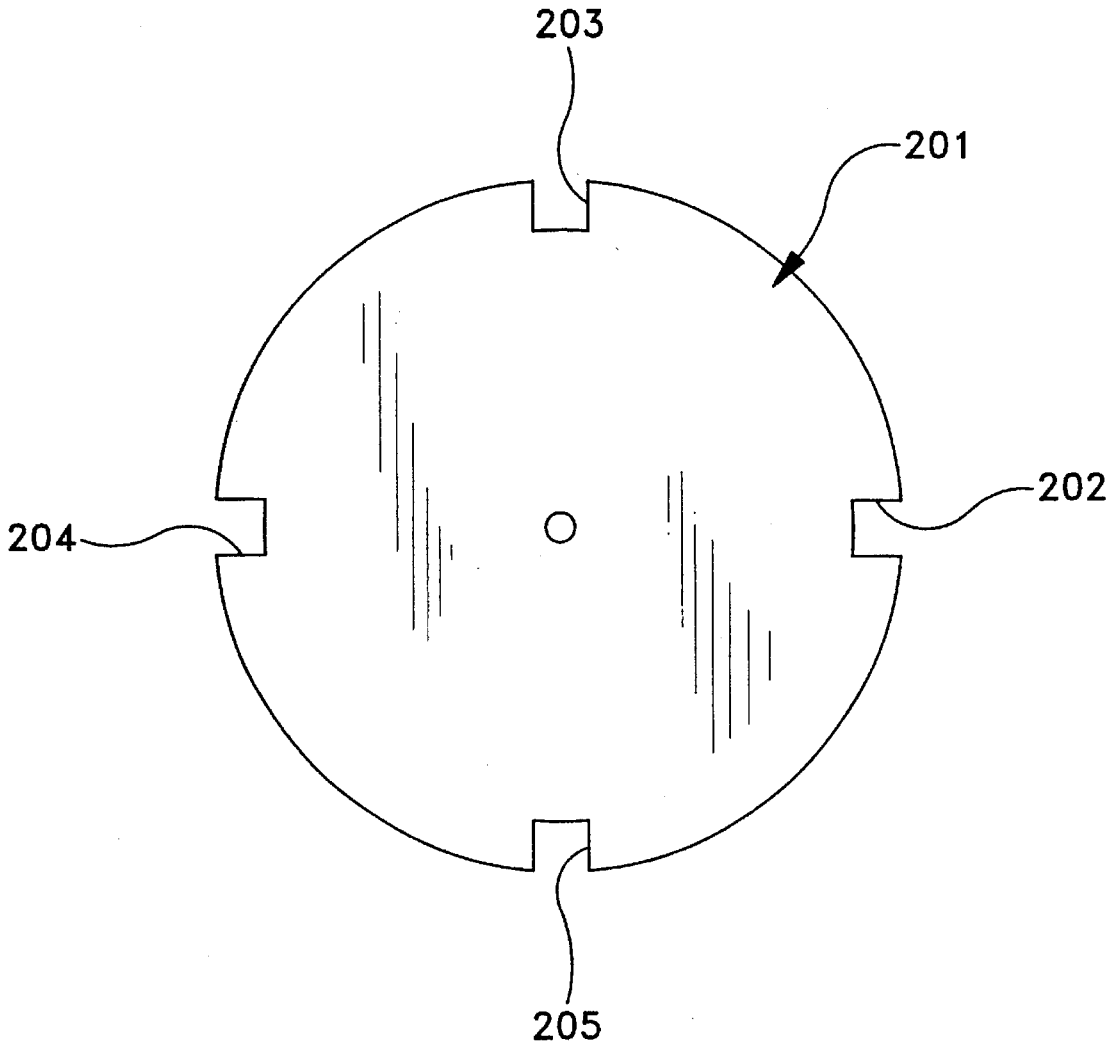
FIG. 3 is a plan view of the upper rotatable disk of one embodiment of the device of the invention.

FIG. 3 illustrates the rotatable upper disk 201 which is adapted to be mounted over disk 101 on base 1, the center of circles 3 and 2 on base 1 corresponding to the centers of disk 101 and disk 201. Disk 201 is sized the same as or slightly larger than circle 110 on disk 101. Slots 202, 203, 204 and 205 are provided positioned 90 degrees apart and sized to correspond to the area occupied by a notation on disk 101.

Figure 4:
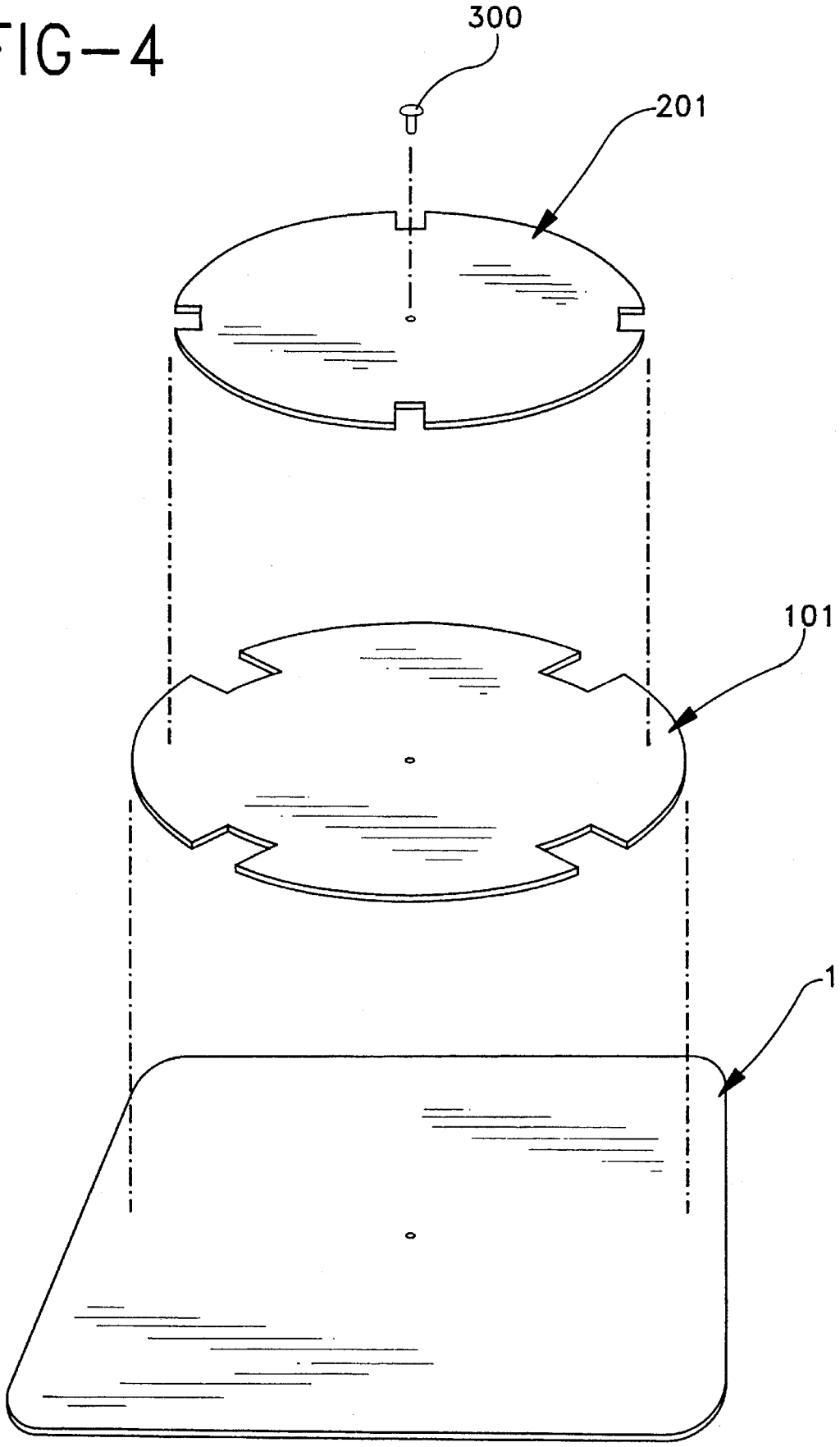
FIG. 4 is an exploded view of one embodiment of the invention.

FIG. 4 is an exploded view showing the relationship of base 1 to lower rotatable disk 101 and upper rotatable disk 201.

Figure 5:
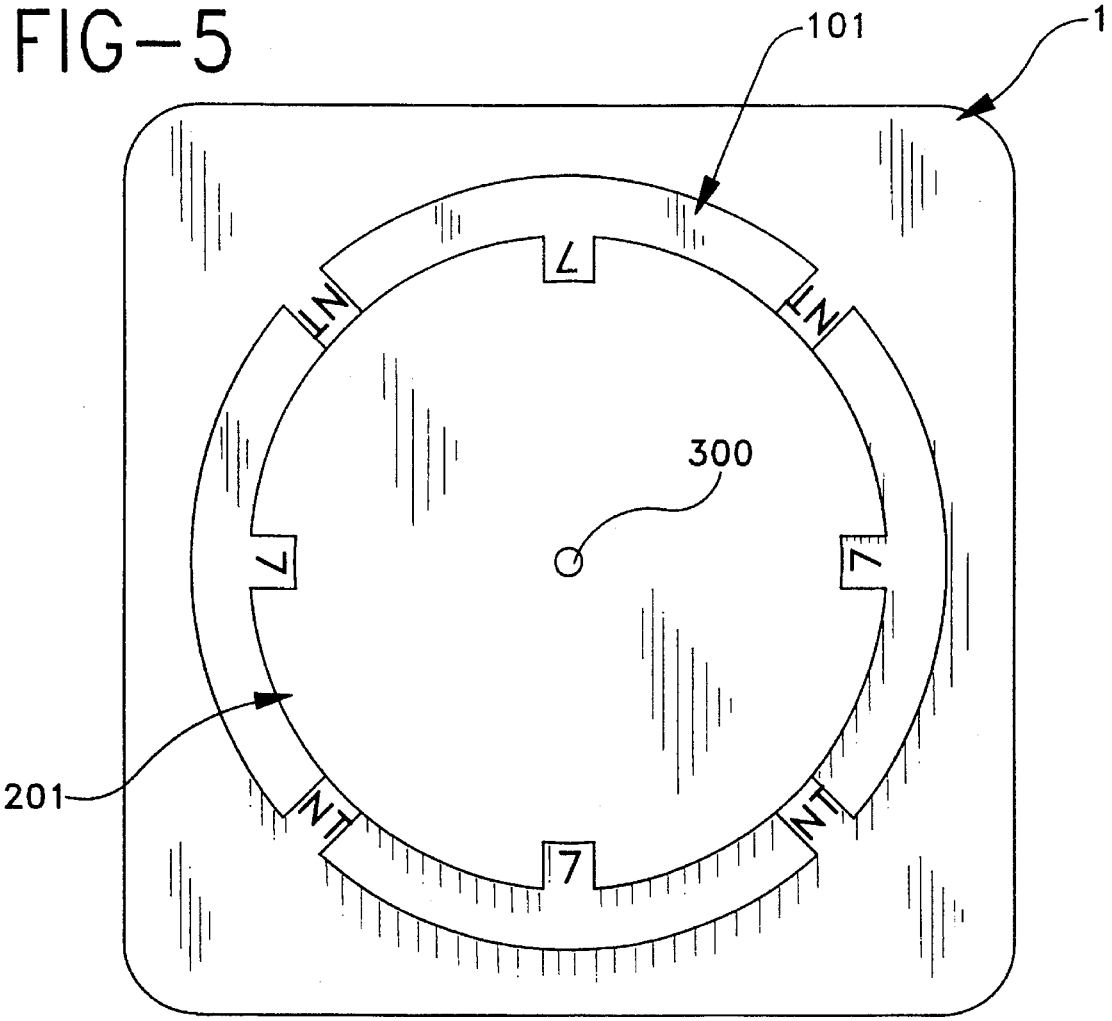
FIG. 5 is a plan view of the assembled device of the embodiment of the invention of FIGS. 1–4.

FIG. 5 is a plan view of the device of FIGS. 1–4 illustrating a 7 NT bid.

Figure 6:
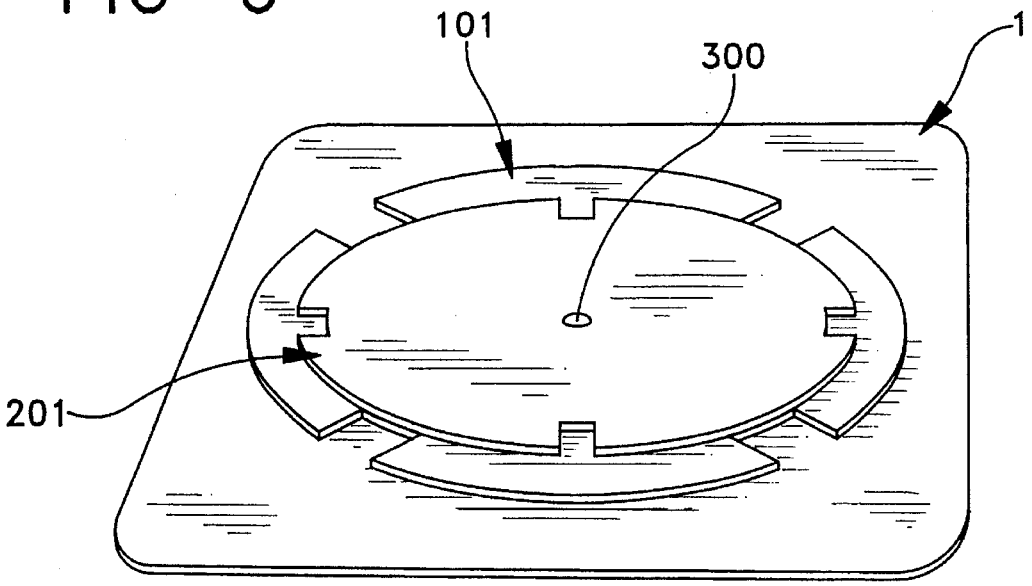
FIG. 6 is a perspective view of the assembled device of the invention of FIGS. 1–4.

FIG. 6 is a perspective view illustrating the assembled device of FIGS. 1–5 and also showing a bid of 7 NT.

Operation of the device of the invention illustrated in FIGS. 1–6 is simple and straightforward. After a contract bridge hand is dealt to all four players, the dealer conveys his bid to the other players in a non -verbal way using the illustrated device which is conveniently positioned near the center of the playing table. The dealer manually rotates disk 101 until the desired notation spade, heart, diamond, club, NT or P appears in the disk 101 slot in front of him and in the other three slots. If the notation spade, heart, diamond, club or NT is selected, the dealer then rotates disk 201 until the desired number 1 through 7 appears in the four slots in disk 201, thus communicating in a non-verbal way the dealer's bid to all four players.

The bid then moves clockwise to the next player who likewise bids in a non-verbal way by rotation of the rotatable disks.

For example, if the dealer wishes to open the bidding with a bid of 2 spades, he rotates disk 101 until the spade notation appears through the slots 102, 103, 104 and 105 in disk 101, and he rotates disk 201 until the number 2 appears through each of the slots 202, 203, 204 and 205 in disk 201.

If the next player wishes to overcall with a bid of 3 clubs, he rotates disk 101 until the club notation appears through the disk 101 slots 102, 103, 104 and 105 and he rotates disk 201 until the number 3 appears through the slots 202, 203, 204 and 205 in disk 201.

This procedure is repeated around the table until a final contract is reached. Note that in the case where disk 101 is rotated by a player so that P, DBL or RDBL appears, disk 201 can be rotated so that no notation appears through the disk 201 slots although this is not strictly necessary since the average bridge player understands that no number is associated with bids of P, DBL or RDBL.

While in the FIGS. 1–6 the four slots in each of disk 101 and disk 201 are shown as extending to the outer circumference of each disk, it will be understood that the slots need not extend to the disk circumference but can be positioned in from the disk circumference. The slots must align, however, with the notations below them, i.e. the disk 101 slots must align with the base bid notations and the disk 201 slots must align with the disk 101 number notations.

The disks 101 and 201 are suitably rotatably mounted on base 1 by pin or rivet 300 as shown or by equivalent means.

Figure 7:
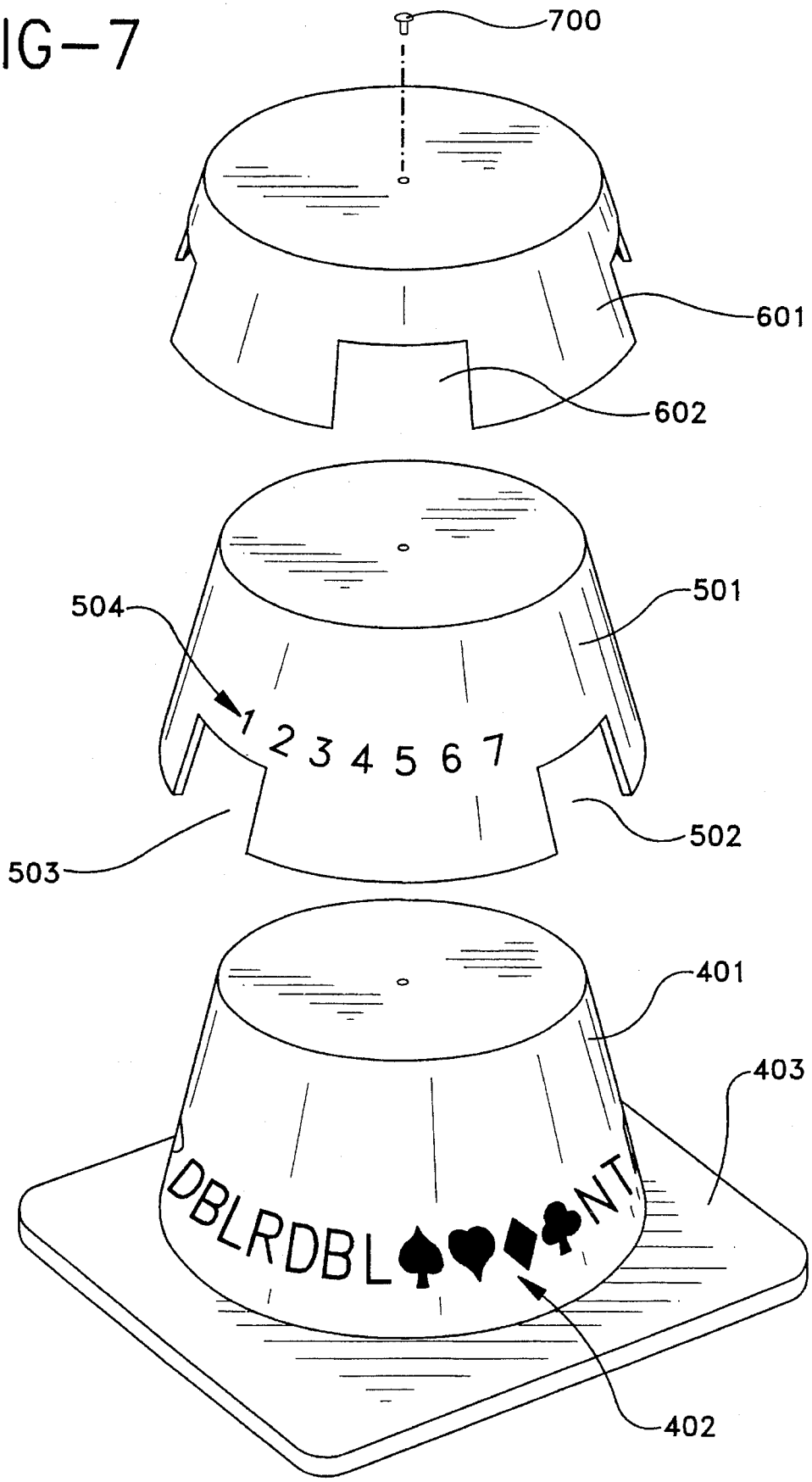
FIG. 7 is an exploded view of an alternative embodiment of the invention.

FIG. 7 illustrates an alternative embodiment of the invention. In this embodiment, the base member and the lower and upper rotatable members are each in the form of a truncated cone. Otherwise the notation and slot configurations are similar to those above described.

Referring to FIG. 7, base member 401 is provided in the form of a truncated cone provided with 4 identical groups or clusters of the bidding notations space, heart, diamond, club, NT (no trump), P (pass), DBL (double) and RDBL (redouble). Each notation is spaced 90 degrees from the corresponding adjacent notations; for simplicity, only one cluster 402 is illustrated in FIG. 7. As shown in FIG. 7, base member 401 is securely mounted on flat member 403 which can be square or round, although this is not strictly necessary.

Lower rotatable member 501 is provided also in the form of a truncated cone adapted to closely fit over base member 401, which lower member is conveniently rotatable with respect to base member 401. Member 501 has four open slots, two of which are illustrated by 502 and 503, which are spaced 90 degrees apart and which are sized to provide an open area which corresponds to the area of a single notation on base 401 such that member 501 can be rotated and a single notation on base 401 will be identically revealed through each of the 4 slots of member 501.

In addition to the slots, lower rotatable member 501 has four identical groups or clusters illustrated by 504 containing the bidding notations 1, 2, 3, 4, 5, 6 and 7. These notations are positioned 90 degrees from each adjacent corresponding notation.

Upper rotatable member 601 is provided also in the form of a truncated cone adapted to closely fit over lower rotatable member 501. Member 601 is rotatable with respect to lower member 501. Member 601 has four open slots, illustrated by slot 602, which are spaced 90 degrees apart and which are sized to provide an open area which corresponds to a single notation on lower member 501 such that member 601 can be rotated and a single notation on lower member 501 will be identically revealed through each of the 4 slots of member 601.

Figure 8:
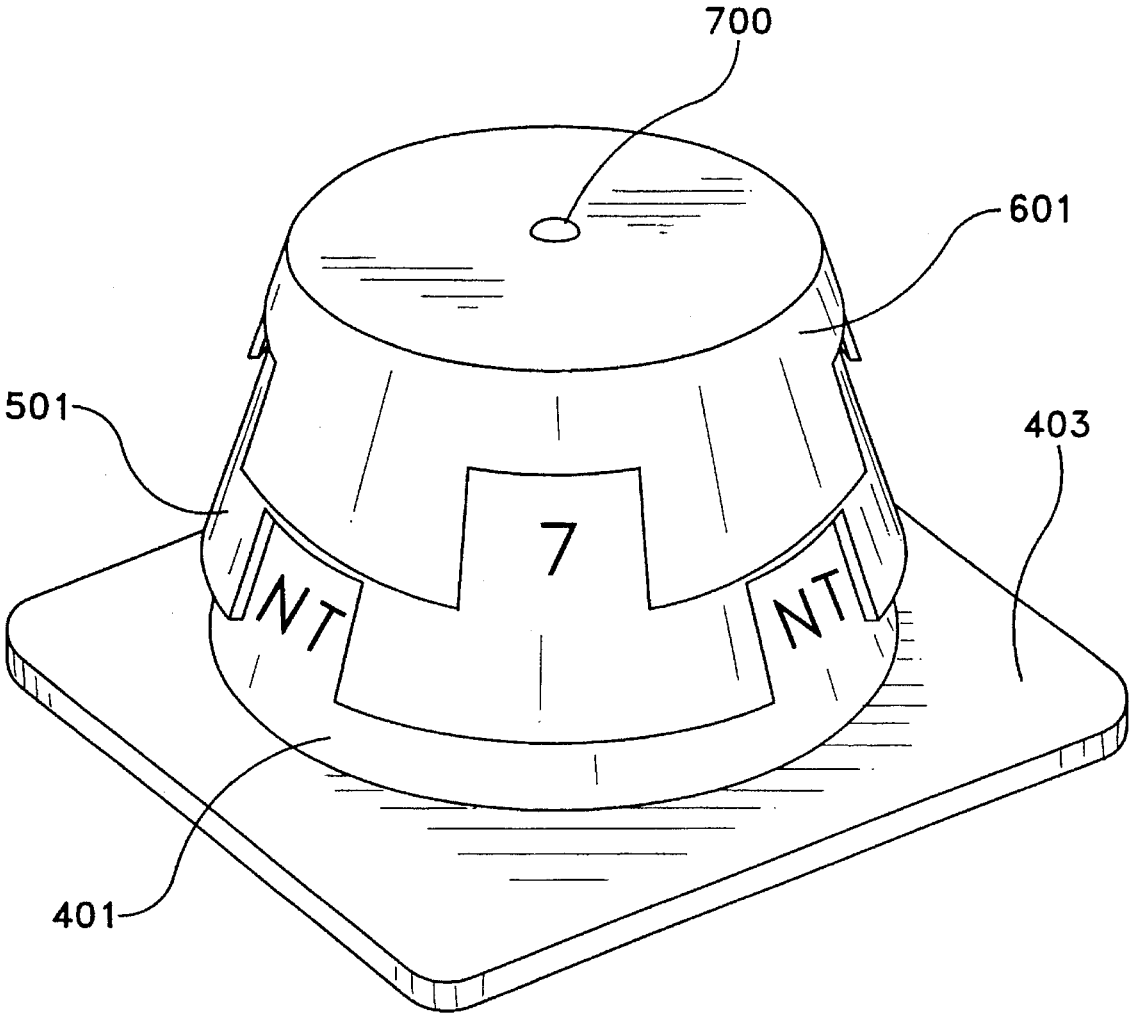
FIG. 8 is a perspective of the assembled embodiment of the invention shown in FIG. 7.

FIG. 8 is a perspective of the assembled device of FIG. 7 showing one 7 NT bid. The other three positions which show the same bid are not shown.

The device of FIGS. 7 and 8 operates in a fashion similar to that described in connection with FIGS. 1–6. An advantage of the truncated cone configuration is that it affords better visibility to the players of the various bids. The three members of the truncated cone configuration are secured as by a pin or rivet 700 as in the previous embodiment.

We claim:

1. A device for non-verbal contract bridge bidding comprised of a base, a first lower rotatable member mounted on top of said base adapted to be separately and manually rotated, and an upper second rotatable member mounted on top of said first member on said base adapted to be separately and manually rotated, said base having four groups of first notations each group of first notations having the same sequence of notations identifying the card suits, no trump, pass, double and redouble, each group of first notations spaced 90 degrees from each adjacent group, said first lower member having four open slots located 90 degrees apart each slot adapted to identically expose only one first notation on said base while the remaining first notations are covered from view by said first lower member, said first lower member having four groups of second notations each group of second notations having the same sequence of notations 1, 2, 3, 4, 5, 6 and 7, each group of second notations spaced 90 degrees apart, said second upper member having four open slots located 90 degrees apart each slot adapted to identically expose only one second notation on said first member while all the remaining second notations are covered.

2. The device of claim 1 wherein the base is flat and said first and second rotatable members are disks.

3. The device of claim 1 wherein the base and said first and second rotatable members are truncated cones.

* * * * *